United States Patent [19]

Veith

[11] 4,047,077

[45] Sept. 6, 1977

[54] DISCHARGE DISPLAY DEVICE (PLASMA-PANEL)

[75] Inventor: Werner Veith, Munich, Germany

[73] Assignee: Siemens Aktiengesellschaft, Berlin & Munich, Germany

[21] Appl. No.: 647,991

[22] Filed: Jan. 9, 1976

[30] Foreign Application Priority Data

Feb. 26, 1975 Germany ..... 2508393

[51] Int. Cl.[2] ..... H05B 41/16

[52] U.S. Cl. ..... 315/169 TV; 313/188; 313/195; 313/217; 315/337; 340/324 M

[58] Field of Search ..... 315/169 TV, 337, 350; 340/173 PL, 324 M; 313/188, 195, 217

[56] References Cited

U.S. PATENT DOCUMENTS 3,921,021 11/1975 Glaser et al. ..... 313/188

3,938,135 2/1976 De Jule et al. ..... 315/169 TV X

*Primary Examiner*—Eugene R. LaRoche

*Attorney, Agent, or Firm*—Hill, Gross, Simpson, Van Santen, Steadman, Chiara & Simpson

[57] ABSTRACT

A discharge display device is constructed in the form of a plasma panel in which a gas-filled, gas-tight housing contains, as electrode system components of a primary gas discharge path, an insulating matrix having holes therein spaced at regular intervals in accordance with the number of image points as a carrier of two divided electrodes assigned to the discharge cells. The divided electrodes include metal conductor paths arranged, for example, in rows and columns, in particular an auxiliary anode and a control electrode, and a common surface cathode is arranged in such a manner that electrons emerge from the individual holes of the matrix in a controlled fashion. The electrons enter respective d.c. gas discharge paths provided in an insulating hole matrix, which exhibits the same hole spacing and which is in registry with the first-mentioned hole matrix, and cause the individual, bombarded discharge cells to ignite.

20 Claims, 1 Drawing Figure

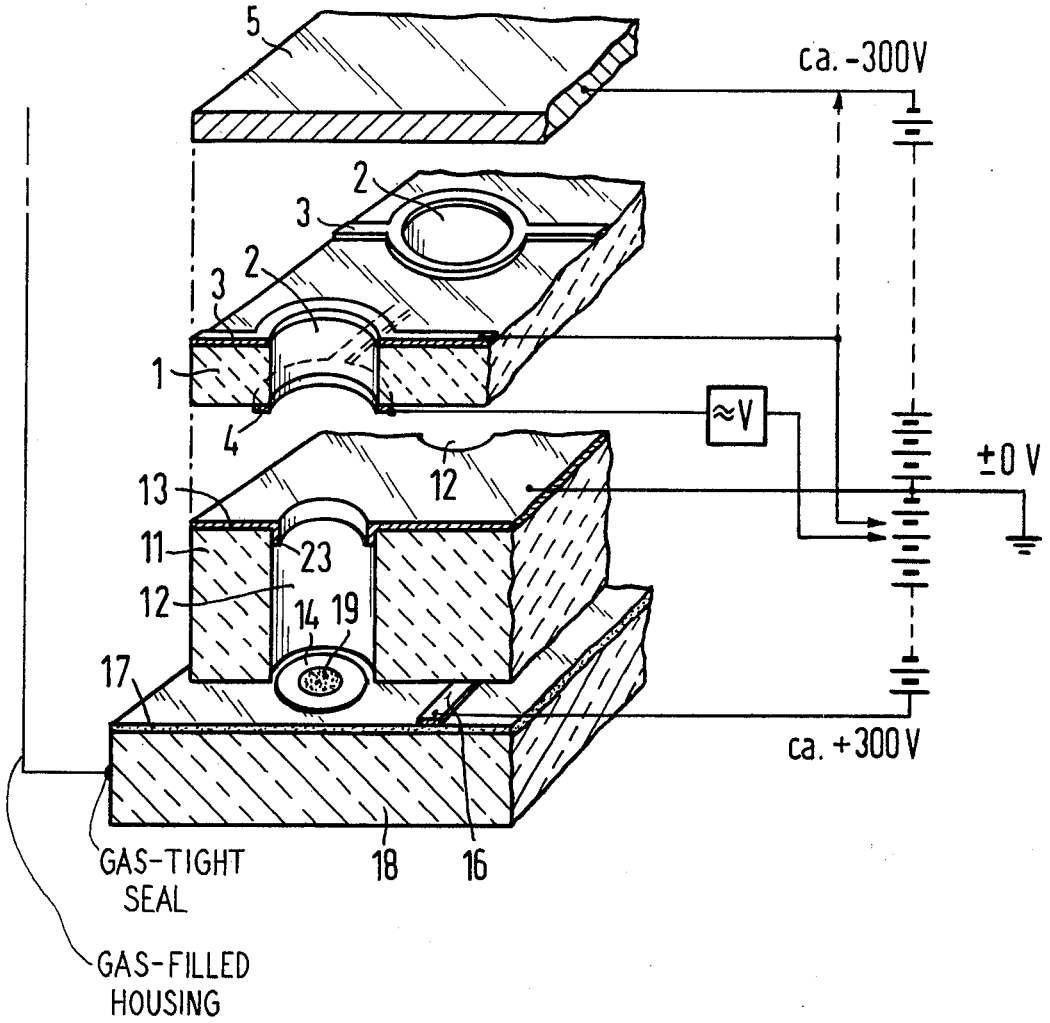
5
ca. -300V
2
3
2
3
1
4
≈V
±0 V
13
12
11
23
12
14
19
17
ca. +300 V
GAS-TIGHT
SEAL
18
16
GAS-FILLED
HOUSING

DISCHARGE DISPLAY DEVICE (PLASMA-PANEL)

CROSS REFERENCE TO RELATED APPLICATION

This application is related to, and considered an improvement over, my prior application, Ser. No. 558,495, filed Mar. 14, 1975, now U.S. Pat. No. 3,956,667 and assigned to the same assignee as the present invention.

BACKGROUND OF THE INVENTION

1. Field of the Invention

This invention relates to discharge display devices, and is more particularly concerned with discharge display devices which are constructed as plasma panels.

2. Description of the Prior Art

In a discharge display device of the type disclosed in my prior application, Ser. No. 558,495, now U.S. Pat. No. 3,956,667 an insulating matrix which is provided with holes divides a common discharge chamber into an auxiliary gas discharge chamber exhibiting a large discharge path for operation with a low voltage, and into an electrode acceleration chamber possessing a very short discharge path so that no gas discharge takes place at a high voltage, and serves as a carrier at least for the auxiliary anode which is divided up into rows, and possibly also for the control electrode which is arranged on the other side and which is divided up into columns extending at right angles to the rows, while the cathode and the anode, in particular as screening electrodes, are designed as common electrodes with correspondingly large areas.

By providing that the potential of each of the conductor paths of the auxiliary anode arranged on the front side of the insulating holed matrix is consecutively raised to a few hundred volts, e.g. +300 V, in relation to the cathode potential, a narrow, approximately wedge-shaped gas discharge is ignited in rows over the entire surface of the insulating holed matrix and is stepped onward (self scanning), and from this primary gas discharge, with a sufficiently positive control signal (V) electrons are extracted more or less in a beamed fashion through the holes, corresponding to the image points, by means of the conductor paths of the control electrode which are arranged on the other side of the insulating holed matrix in the form of columns and at right angles to the insulating matrix, whereupon the electrons are accelerated on a sufficiently short discharge path without the ignition of a gas discharge in accordance with the known Paschen's curve toward the anode which, for example, is designed as a screening electrode. Therefore, this is, for example, an arrangement which is suitable for the reproduction of moving pictures, possibly also in color. A prerequisite of this arrangement is an item of information which, similarly to the video signal of a picture tube, is periodically repeated, although the content of the information can change constantly. Therefore, one of its applications is for the reproduction of gray tones, although it does not possess storage facilities.

SUMMARY OF THE INVENTION

The object of the present invention is, in the type of device described herein, to provide the possibility of additional storage for special, specific uses, and therefore to also attain a greater degree of brightness. The present invention therefore represents an advantageous modification, in the sense of a further development.

The present invention is based on the assumption that stored images of this kind basically consists of single texts, numbers or curves, possibly output from a computer. Gray-tone reproduction is not necessary and could possibly be achieved by the density of the image points, when the points exhibit a uniform degree of brightness, similarly as in newspaper printing. The possibility of representing a large color scale is also of importance, although of subordinate importance, and although a few particular colors may be of interest.

The foregoing is achieved in a discharge display device of the plasma panel type, in which a gas-filled, gas-tight housing contains, as electrode system components of a primary gas discharge path (auxiliary or control path), an insulating matrix which is provided with holes at regular intervals corresponding to the number of image points (display elements), for a gas discharge cell matrix as a carrier of two split electrodes which are assigned to the discharge cells. The electrodes consist, for example, of metal conductor paths arranged in rows and columns, in particular an auxiliary anode and a control electrode, and also a common surface cathode, which are arranged in such a manner that electrons emerge in controlled fashion out of the individual holes of the insulating holed matrix from the gas discharge in the manner set forth in the aforementioned application, Ser. No. 558,495. According to the invention, the electrons enter d.c. gas discharge paths which are divided up by an insulating holed matrix featuring the same hole spacing with the holes in registry with the holes of the first-mentioned matrix, and cause the individual, bombarded discharge cells to ignite. To this end, the main d.c. discharge path (storage gas discharge path) which is connected directly following the primary (auxiliary, control) discharge path basically also consists of a similar insulating holed matrix provided with the same hole spacing into the holes of which (cylindrical holes) at the input end side projects a cohesive metal coating provided with corresponding registering holes, serving as a common cathode of the d.c. gas discharge path. In each case the holes of the metal coating include short squared off ridges which extend into the holes of the second-mentioned insulating matrix. The anode is formed by metal rings in an arrangement geometrically assigned to the holed matrix, which rings are arranged on the rear surface of the front glass plate which seals off the discharge chamber on the appertaining side of the holed matrix. The metal rings are connected to one another via conductor paths and in each case project into the individual discharge cylindrical holes of the second-mentioned insulating matrix. These parallel individual gas discharge paths serve the function of a gas discharge having storage facilities.

Therefore, as a deviation from the device described in my aforementioned application, Ser. No. 558,495, the electrons produced in the primary discharge are not accelerated along a very short path to a luminescent screen, but instead are injected into a second gas chamber which has the same composition as that of the primary gas discharge path, i.e. forms part of the common gas chamber.

By providing a sufficient distance between the electrodes in this subsequently connected main discharge path, it is ensured that even when a small voltage, of for example +200–+400 V, is connected, a gas discharge will ignite in this chamber when a sufficiently large electron stream enters, e.g. from the control chamber. To this end, the voltage difference across the electrodes of this discharge chamber, which has been divided into parallel, individual d.c. discharge paths, is set to be precisely that required to prevent ignition occurring without the electrons injected from the primary path. However, once the main path has ignited, it continues to burn uninterrupted until it is deliberately extinguished. As a continuous d.c. discharge is of concern here, the same enables a very great degree of brightness to be achieved—at any rate greater than that which is possible with displays provided with storage facilities currently available in the market, as, of course, such displays are operated with a.c. voltage as a.c. discharges in such a manner that the duration of the luminescence is limited to a length of time which is very short in relation to the period of the voltage in the region of the voltage change.

The utilization of d.c. gas discharges for plasma panels is also known in the art, e.g. from the work of J. Smith, as reported in the IEEE Trans., Vol. ED-20, No. 11, 1973, p. 1103, with the difference, however, that such discharges are used, as it were, only for one stage, i.e. for the control process itself. As is known, gas discharges possess negative characteristics which means, for example, that for plasma panels a large series resistance must be installed in each single gas discharge path to limit the discharge current. In the arrangement disclosed in the above-mentioned work, these resistances are in the form of CrNi spirals in the anode lines. It is particularly advantageous for the production technique of a few other electrode system components, e.g. the silk screen printing technique, to deposit a cohesive resistance layer consisting, for example, of carbon or another customary resistance material, such as, for example, CERMET, of the usual type from the gas phase onto the front glass plate in such a manner that the material forms a resistance connection between the anode rings and the supply line conductor paths. In order to increase the brightness, and in particular when necessary of a particular color for the display, advantageously luminescence substance is additionally applied to the front glass plate within the anode rings, either directly or upon the resistance layers, and possibly also on the walls of the cylindrical holes.

BRIEF DESCRIPTION OF THE DRAWING

Other objects, features and advantages of the invention, its organization, construction and operation will be best understood from the following detailed description of an exemplary embodiment of the invention in conjunction with the accompanying drawing, on which a single FIGURE is a fragmentary perspective view of a discharge display constructed in accordance with the principles of the present invention.

DESCRIPTION OF THE PREFERRED EMBODIMENTS

Referring to the drawing, which as stated above is a schematic and fragmentary perspective view of an arrangement constructed in accordance with the invention, a first insulating holed plate, referred to as an insulating holed matrix 1 is provided and includes a plurality of holes 2 arranged at regular intervals. The matrix 1 may comprise quartz, glass, ceramic or a synthetic material exhibiting a sufficiently low vapor pressure. Extending across the holes 2 are electrode elements of one type of the drive electrodes, in particular in the form of applied conductor paths, e.g. as auxiliary anodes 3 for the row electrodes. The relevant conductor strips or paths 3 are applied to the base, e.g. by printing, vapor deposition or the photo technique. At each hole 2, the relevant conductor strip extends, for example, around the opening and then continues in the form of a narrow conductor strip. Arranged in the same way on the other side of the matrix 1, i.e. on its lower side, is a plurality of conductor paths 4 which extend in columns at right angles to the row electrodes 3 and form the individual elements of the control electrode for the image points (display elements). To this is added a solid cathode 5 at a distance from the holed matrix 1 adequate for a glow discharge, as one of the two electrodes of the primary, auxiliary or control gas discharge path 3–5.

On the operation of a single row by raising the potential of the associated conductor path, e.g. by +300 V, a gas discharge ignites only in the direction of this row, and remains burning at least at this point, as the other row electrodes possess a floating potential or cathode potential. From this narrow, wedge-shaped gas discharge path leading toward the relevant row, the conductor paths of the control electrode 4 on the other side of the holed matrix 1, provided for the individual image points, can withdraw electrons through the individual holes 2 assigned to this row in the holed matrix 1, either one after another or simultaneously through all of the holes, depending upon whether the signal is connected to the individual image point conductor paths in a time sequence or simultaneously for the entire row, when the relevant connected control signal V has a sufficient, correspondingly positive value.

When the primary discharge is stepped on to the next row (self scan), the latter ignites with the aid of the remaining residual ionization from the previous row, when the latter has previously been extinguished. The gas discharge is thus stepped on, as it were, in particular in the rhythm of the row frequency from row-to-row over the entire insulating holed matrix 1 (self scan), and is in each case restricted solely to the individual gas discharge path. The control electrode 4, which is arranged on the other side of the insulating holed matrix 1, and which is likewise divided into parallel elements in the form of columns, thus divided into conductor paths, functions as the image point electrode through the holes in that it controls the flow of electrons emerging from the gas discharge, but not their intensity. In the event of a sufficiently negative biasing of the control electrode 4, vis-a-vis the auxiliary anode 3, the electron stream is blocked, i.e. the control electrode 4 controls the electron stream passing through the relevant hole in the manner of a gate.

The electrons emerging in this manner from the primary discharge path under the control of the control electrode 4, thus from the control chamber, now pass directly into a subsequently connected gas discharge path—a d.c. gas discharge path—namely, the main d.c. gas discharge path.

To this end, a similar holed matrix 11 is arranged at a short distance from the holed matrix 1 of the primary discharge path. The insulating holed matrix 11 includes cylindrical holes 12 which are arranged in an identical pattern to the holes 2 and are in axial registration therewith so as to represent continuations of the holes 2 of the matrix 1. The cylindrical holes 12 of the insulating holed matrix 11 also form the individual parallel-connected discharge chambers, and the matrix 11 also serves as a carrier for one of or both of the electrodes.

At one side of the matrix, its discharge input side, a cohesive coating 13 commonly serves as a cathode, namely as a main cathode. The coating 13 also includes a matrix of holes which are defined by short projecting edges 23 which project into the individual holes 12. Arranged on the other side of the matrix 11 is a front glass plate 18, and more particularly a front glass plate which serves to close off the entire gas discharge chamber and also serves for observation purposes. Arranged on the rear surface of the front glass plate 18 is a plurality of metal rings 14, each of which projects into the individual cylindrical holes 12 and serves as an individual anode for that particular discharge path, the metal rings 14 receiving anode potential through a cross lattice of conductor paths (conductor network) 16 likewise arranged on the rear surface of the front glass plate 18. Therefore, each individual d.c. discharge path comprises the two electrodes 13, with its projecting edge 23, as a cathode and a ring 14 as an anode.

The well-known negative characteristic of gas discharges means that each single gas discharge path must exhibit an equal value series resistance which, in fact, serves to limit the discharge current. This can take place both at the cathode end and at the anode end. For this purpose, for example, supply lines 17 in the form of a resistance are also arranged on the rear surface of the front glass plate 18 between the anode rings 14 and the metal conductor paths 16. Therefore, for example, arranged between the anode rings 14 and the lattice of metallic conductor paths 16 which are applied to the front glass plate 18, e.g. by silk screen printing, is a cohesive resistance layer 17 which is deposited, for example, from carbon and, in fact, from the gas phase in the manner generally known in the production of resistances. Another possibility resides in the utilization of a customary resistance material, like CERMET, which is applied in place of carbon, again in a conventional manner. A third possibility consists in the use of the resistance spirals mentioned by J. Smith in the aforementioned IEEE publication, which spirals are composed of a material having a greater conductivity which is either vapor deposited or sputtered into position. Therefore, these resistance elements, which represent resistance connections, are applied, e.g. to the rear surface of the front glass plate 18 prior to the application of the individual anode rings and of the associated conductor paths 16.

A luminescence screen substance serving, for example, to increase the brightness or, however, for purposes of reproduction in a desired color, or even several colors, is applied in the form of small sub-screens 19 onto the front glass plate 18, preferably inside the anode rings 14, either directly or upon the resistance layers 17, and possibly additionally upon the walls of the cylindrical holes 12.

At a fixed electrode spacing between the cathode 13 and an anode 14 in the individual d.c. discharge paths, in dependence upon the gas pressure and the diameter of the cylindrical holes 12, the potential difference is set to be such that it prevents ignition from occurring. Only as a result of the injection of electrons out of the primary discharge path through the control electrodes into the individual d.c. discharge path does a continuous d.c. discharge take place, as a result of the ionization which then occurs, which continues to burn uninterrupted until it is deliberately extinguished. The high degree of brightness obtainable with this discharge is limited only by the limiting resistances 17, in terms of discharge strength. Its degree of brightness is very much greater than corresponding similarly designed a.c. discharge paths which are operated with a.c. voltage and whose luminescence duration is limited to a length of time which is very short in comparison to the period, in the vicinity of the voltage change. A feature which is of importance for the formation of the discharge characteristic of the individual d.c. discharge path 13–14, is the edge which is provided on the cohesive overall cathode 13 and which projects into each of the individual cylindrical holes 12. Advantageously, this is achieved during the vapor deposition of the cohesive cathode layer by means of a regular pivoting movement during the rotation of the holed matrix 11. In operation, the potential of the cathode 13 is selected to be approximately 40 V more negative than that of the control electrode 4 of the primary discharge path in order that, in the event of a variation in the potentials across the control electrode 4, the discharge will continue to burn between the electrodes 13 and 14 and will not, for example, jump onto the control electrode 4, as it is vitally required that the control electrode remain free of load for the variation of the control voltage. To this end, it is additionally necessary that in order to block the electrons from the primary gas discharge, the potential across the control electrode should be no more negative than that across the main cathode.

When a d.c. gas discharge is used for purposes of a display device featuring storage facilities, it is of vital importance that the d.c. gas discharge path should be able to be extinguished point-by-point, for example in order to correct an erroneous input letter. In the main gas discharge path 13–14, electrons are, in fact, constantly triggered at the edges 23 of the cathode 13 as a result of ion impact, and, having been accelerated to the anode 14, constantly gives rise to ionization in the individual discharge chamber 12. Therefore, in order to extinguish the individual discharge path, it is necessary to prevent the triggered electrons from constantly returning to the discharge chamber 13–14. The individual extinction of an individual gas discharge is, therefore, actually initiated from the primary discharge path in that the relevant row conductor path of the auxiliary anode 3 is connected with an increased positive potential which is higher than that used for the ignition of the primary discharge path 3–5, and the relevant column conductor paths of the control electrode 4 are connected with a potential which is reduced in relation to the auxiliary anode 3, to as much as 0 V vis-a-vis the main cathode 13. This causes the electrons triggered by ion impact on the main cathode 13 to be drawn to the primary discharge path 5–3, so that the individual d.c. gas discharge paths again assume and retain their unignited state. The penetration through the individual control opening 4 produces a strong electric field across the main cathode 13 which draws away from the cathode 13 electrons which arise thereacross due to ion impact. Thus, this d.c. discharge path between the electrodes 13 and 14 lacks the requisite charge carriers, so that the discharge is extinguished in punctiform fashion.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A discharge display device in the form of a plasma panel, comprising:

a gas-filled, gas-tight housing;

a primary discharge arrangement in said housing, said primary discharge arrangement including a common first cathode, a first insulating matrix spaced from said first cathode and comprising a first insulating plate having a plurality of holes therethrough arranged in an array of rows and columns and corresponding in number to a desired number of image points, a plurality of first anodes carried on one side of said first insulating plate facing said first cathode, each of said anodes associated with a respective row of holes and extending about the edge of the holes, and a plurality of control electrodes carried on the other side of said first insulating plate, each of said control electrodes associated with a respective column of holes and extending about the edge of the holes, the cathode, first anodes and control electrodes adapted to be connected to potentials to cause electrons to emerge from the holes in a controlled fashion from the gas discharge; and a plurality of main d.c. discharge paths, each of said discharge paths being defined by a second cathode and a second anode and being divided by and including a second insulating matrix aligned with said first insulating matrix, each of said second cathodes and said second anodes adapted to be connected to a potential to cause each of said d.c. discharge paths to be ignited by electrons received from the holes of said first insulating matrix.

2. The device of claim 1, wherein said second insulating matrix is spaced from said first insulating matrix and comprises a second insulating plate having a plurality of holes therethrough aligned with the holes of said first insulating matrix, said second cathodes forming a cathode common to all of said discharge paths, said common second cathode carried on one surface of said second insulating plate facing said control electrodes and including a plurality of holes therethrough aligned with the holes in said second insulating plate, a front viewing screen sealed to said housing, said second anodes carried on said screen in the form of anode rings each aligned with and extending into a respective hole in said second insulating plate on the other side of said second cathode to form individual discharge cells, conductor paths carried on said side of said screen adjacent and spaced from said anode rings, and a resistance carried on said screen connecting said anode rings and said conductor paths, said second cathode and said conductor paths adapted to receive potentials and electrons received in the individual discharge cells are effective to trigger ignition.

3. The device of claim 2, wherein said common second cathode comprises projections about the edge of each hole in said common second cathode, each of said projections extending into the respective hole in said second insulating plate.

4. The device of claim 2, wherein each of said first and second insulating plates comprises a material having a low vapor pressure, and wherein the holes in said first and second insulating plates have common axes.

5. The device of claim 3, wherein said first and second insulating plates consist of glass.

6. The device of claim 3, wherein said first and second insulating plates consist of ceramic.

7. The device of claim 3, wherein said first and second insulating plates consist of a synthetic material.

8. The device of claim 2, wherein said viewing screen comprises glass.

9. The device of claim 2, wherein said resistance comprises a layer of electrically resistive material carried on said other surface of said screen at least in areas between associated conductor paths and anode rings.

10. The device of claim 9, wherein said resistive material comprises carbon.

11. The device of claim 9, wherein said resistive material comprises CERMET type material.

12. The device of claim 9, wherein said resistive material comprises deposited resistive material.

13. The device of claim 2, wherein the transmission coefficient of said first and second matrices is greater than 20%.

14. The device of claim 2, comprising a luminescence substance carried by said screen within said rings.

15. The device of claim 14, wherein said luminescence substance is also carried on the walls of said holes in said second insulating plate.

16. The device of claim 14, wherein said luminescence substance comprises material which is responsive to bombardment to produce a color display.

17. The device of claim 9, wherein said resistive material is carried directly on said screen and said conductor paths and anode rings are carried on said resistive material.

18. A discharge display device in the form of a plasma panel, comprising:

a first cathode;

a first insulating plate parallel to said first cathode and including a plurality of holes therethrough arranged in an array of rows and columns and corresponding in number to a desired number of image points, a plurality of first anodes carried on one side of said first insulating plate facing said first cathode, each of said anodes associated with a respective row of holes and extending about the edge of the holes, and a plurality of control electrodes carried on the other side of said first insulating plate, each of said control electrodes associated with a respective column of holes and extending about the edge of the holes, the cathode, first anodes and control electrodes adapted to be connected to potentials to cause a gas discharge and electrons to emerge from the holes in a controlled fashion from the gas discharge; and a second insulating plate parallel to said first insulating plate and including a plurality of holes therethrough aligned with the holes of said first insulating plate to receive electrons, a second cathode carried on one surface of said second insulating plate facing said control electrodes and including a plurality of holes therethrough aligned with the holes in said second insulating plate, a front viewing screen parallel to said second insulating plate, a plurality of apertured second anodes carried on said screen with each of said second anodes aligned with and extending into a respective hole in said second insulating plate on the other side of said second cathode to form individual discharge cells, conductor paths carried on said side of said screen adjacent and spaced from said apertured second anodes, and a resistance carried on said screen connecting said second anodes and said conductor paths, said second cathode and said conductor paths adapted to receive potentials, and the electrons received in the individual discharge cells being effective to trigger ignition.

19. A process for operating a discharge display device in the form of a plasma panel which has a gas-filled, gas-tight housing having primary auxiliary discharge and main d.c. discharge paths, the primary auxiliary discharge paths including a common cathode, a first insulating matrix spaced from said first cathode and comprising a first insulating plate having a plurality of holes therethrough arranged in an array of rows and columns and corresponding in number to a desired number of image points, a plurality of first anodes carried on one side of the first insulating plate facing the first cathode, each of the anodes associated with a respective row of holes and extending about the edge of the holes, and a plurality of control electrodes carried on the other side of the first insulating plate, each of the control electrodes associated with a respective column of holes and extending about the edge of the holes, the main d.c. discharge paths divided by and including a second insulating matrix aligned with the first insulating matrix, each of the d.c. discharge paths being ignited by electrons received from the holes of the first insulating matrix, the second insulating matrix spaced from the first insulating matrix and including a second insulating plate having a plurality of holes therethrough aligned with the holes of the first insulating matrix, a common second cathode carried on one surface of the second insulating plate facing the control electrodes and including a plurality of holes therethrough aligned with the holes in the second insulating plate, a front viewing screen sealed to the housing, a plurality of second anodes carried on the screen in the form of anode rings each of which is aligned with and extends into a respective hole in the second insulating plate on the other side thereof from the second cathode form individual discharge cells, conductor paths carried on the screen adjacent and spaced from the anode rings and a resistance carried on the screen connecting the anode rings and the conductor paths, the process including the steps of:

applying a first predetermined potential to the first cathode;

applying pulses in sequence to the first anodes to obtain a stepped discharge rhythm across the device in the primary auxiliary discharge paths;

applying a second predetermined potential to the second anodes while holding the second cathode at a reference potential so that the potential therebetween is insufficient to cause ignition in the main d.c. discharge paths; and applying a third predetermined potential to the control electrodes, which third potential is greater than the potential applied to the first cathode, and increasing the potential of the control electrodes above the third predetermined potential to cause electrons to emerge from the primary auxiliary discharge paths and enter and cause ignition in the main d.c. discharge paths.

20. The process of claim 19, comprising the steps of:

increasing the potential applied to selected ones of the first anodes; and decreasing the potential applied to selected control electrodes to draw electrons from the main d.c. discharge paths associated with the intersections of the selected anodes and the control electrodes to extinguish gas discharge in those main d.c. discharge paths.

* * * * *